US007401605B2

(12) United States Patent
Hasegawa et al.

(10) Patent No.: US 7,401,605 B2
(45) Date of Patent: Jul. 22, 2008

(54) FUEL INJECTION CONTROL SYSTEM FOR ENGINE

(75) Inventors: Shumpei Hasegawa, Saitama (JP); Masakatsu Niikura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/364,089

(22) Filed: Mar. 1, 2006

(65) Prior Publication Data

US 2006/0196473 A1 Sep. 7, 2006

(30) Foreign Application Priority Data

Mar. 1, 2005 (JP) ..... 2005-055782

(51) Int. Cl.
*F02D 41/00* (2006.01)
*F02M 1/00* (2006.01)

(52) U.S. Cl. ..... 123/683; 123/434

(58) Field of Classification Search ..... 123/434, 123/683, 704, 360, 361, 376
See application file for complete search history.

(56) References Cited

U.S. PATENT DOCUMENTS 4,515,009 A * 5/1985 Hasegawa et al. ..... 73/118.1
6,044,831 A * 4/2000 Takagi et al. ..... 123/698
6,089,206 A * 7/2000 Suzuki et al. ..... 123/295
6,102,003 A * 8/2000 Hyodo et al. ..... 123/436
6,152,102 A * 11/2000 Ruman ..... 123/295
6,257,218 B1 * 7/2001 Takagi et al. ..... 123/698
6,279,551 B1 * 8/2001 Iwano et al. ..... 123/564
7,021,298 B2 * 4/2006 Nakazawa et al. ..... 123/568.14
7,100,572 B2 * 9/2006 Watanabe et al. ..... 123/429
2004/0079334 A1 * 4/2004 Hasegawa ..... 123/406.52

FOREIGN PATENT DOCUMENTS

JP 6-247392 A 9/1994

* cited by examiner

*Primary Examiner*—John T Kwon
(74) *Attorney, Agent, or Firm*—Birch, Stewart, Kolasch & Birch, LLP

(57) ABSTRACT

A fuel injection control system makes it possible to obtain an output of a lean combustion type engine through an easy operation, even in a throttle opening region of greater than a lean limit. A throttle valve is configured to be turnable up to an over-fully opened position, which is greater than a fully opened position that corresponds to a maximum air flow rate, where the air flow rate is not substantially varied from the maximum air flow rate. In a region where the throttle valve is operated to or above the fully opened position when under a high load, the fuel-air mixture is enriched and a high output is obtained by controlling the throttle opening through operating only a power lever.

18 Claims, 7 Drawing Sheets

FIG. 4
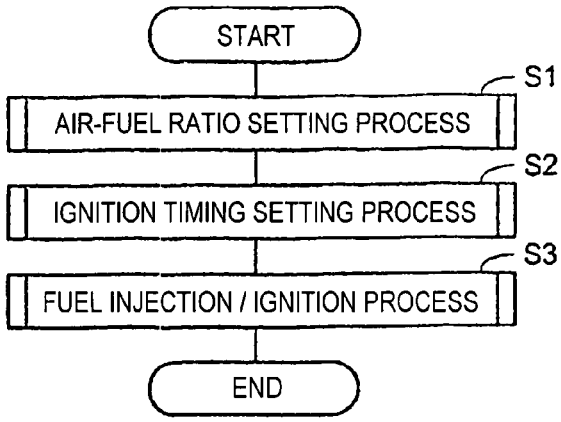
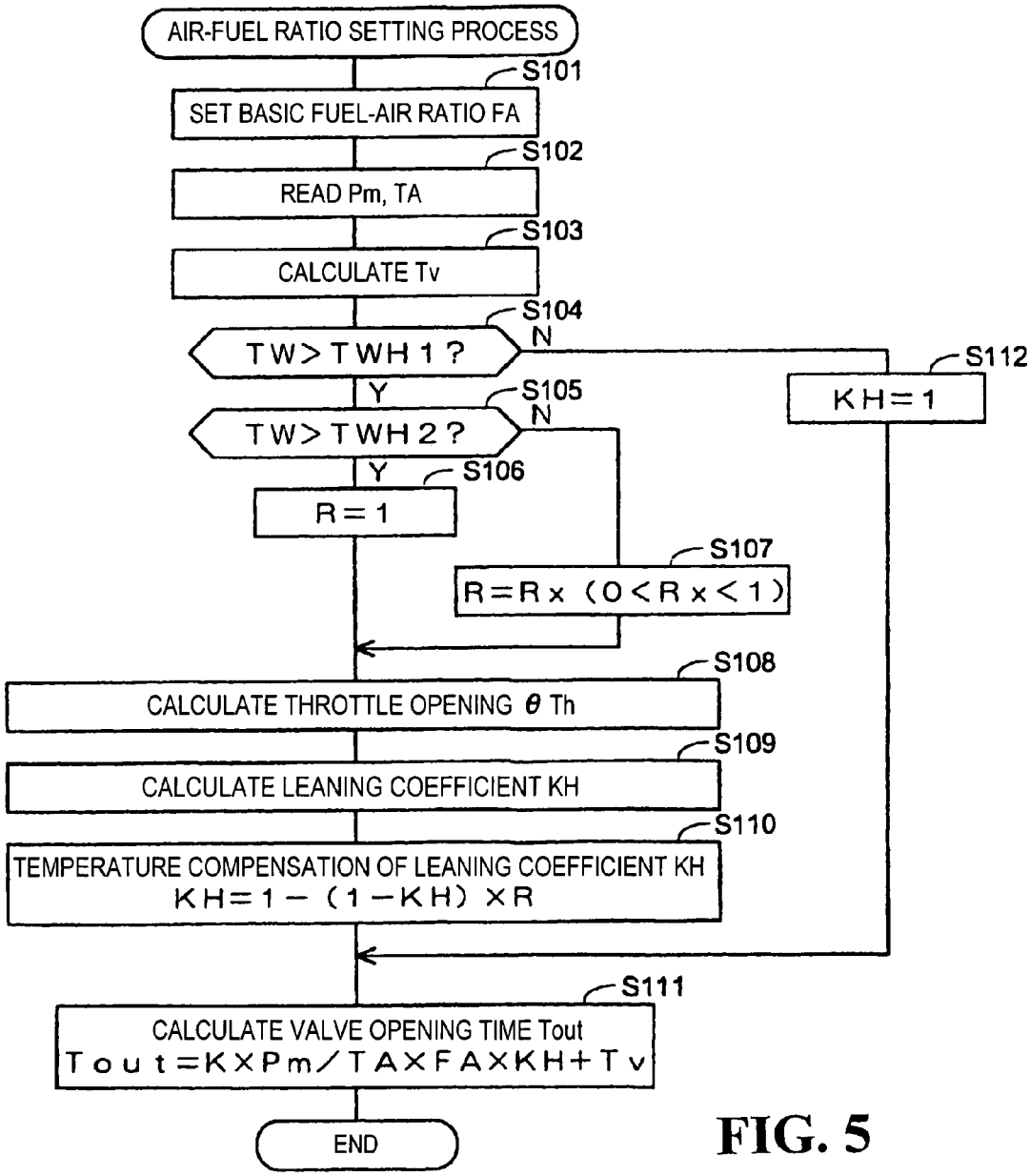
FIG. 5

FUEL INJECTION CONTROL SYSTEM FOR ENGINE

CROSS-REFERENCE TO RELATED APPLICATIONS

This nonprovisional application claims priority under 35 U.S.C. § 119(a) on Patent Application No. 2005-055782, filed in Japan on Mar. 1, 2005, the entirety of which is incorporated herein by reference.

BACKGROUND OF THE INVENTION

1. Field of the Invention

The present invention relates to a fuel injection control system for an engine. In particular, the present invention relates to a fuel injection system for an engine which is suitable for enhancing operability while retaining various performances such as low fuel consumption due to lean combustion in a wide range of operating conditions.

2. Description of Background Art

A lean combustion control has been known where the air-fuel ratio of a fuel-air mixture is controlled to be higher than a theoretical air-fuel ratio at the time of steady operation and the time of gentle acceleration of the engine. For example, in an aircraft reciprocating engine, the air-fuel ratio is gradually shifted to the lean side by operating a mixture control lever provided separately from a power lever for varying the throttle opening. As the air-fuel ratio is gradually shifted to the lean side, the fuel consumption performance is enhanced, but the engine begins to loose ignition when the air-fuel ratio reaches or exceeds a predetermined value. The air-fuel ratio in this instance is called a "lean limit", and its value varies largely depending on whether the engine is of the lean combustion type or not.

FIG. 12 is a diagram showing an example of the relationship between the air-fuel ratio (corresponding to the throttle opening) and the fuel consumption rate, for a lean combustion type engine and an ordinary engine. In the case of the ordinary engine, the lean limit is present in the vicinity of an air-fuel ratio of 17. In the case of the lean combustion type engine, the lean limit is present on the leaner side. Therefore, a low fuel consumption rate is maintained even when the leanness is brought to such a point that the quantity of air cannot be increased further, by fully opening the throttle valve.

In the case of the ordinary engine, the throttle opening at the lean limit is generally set in the vicinity of an intermediate opening. In order to open the throttle valve further so as to increase the suction air quantity, the mixture control lever is manually operated together with the power lever so as to enrich the fuel-air mixture according to the output, whereby the engine output characteristics can be secured.

Such a control system for an aircraft reciprocating engine is disclosed, for example, in Japanese Patent Laid-open No. Hei 6-247392.

In the background art as above-mentioned, in order to increase the fuel injection amount after the lean limit is reached in the ordinary engine, it is necessary for the pilot to operate the mixture control lever separately from the power lever, so as to regulate the fuel injection amount. Specifically, the pilot must operate both the power lever and the mixture control lever.

Furthermore, in the background art, even in a range in the vicinity of or on the lean side of the lean limit, the engine ignition timing has been set on the basis of only the engine speed. Therefore, there has been the problem that when the air-fuel ratio is shifted to the lean side by a lean combustion control, it is difficult to achieve ignition in the engine at an optimum timing.

SUMMARY OF THE INVENTION

It is an object of the present invention to provide a fuel injection control system for an engine, which is suitable for enhancing the operability while retaining various performances such as low fuel consumption due to lean combustion in a wide range of operating conditions.

In order to attain the above object, the present invention is directed to an injection control system for an engine, including a manifold pressure sensor, a calculating unit for calculating a fuel injection amount according to an output from the manifold pressure sensor, a throttle opening sensor, and a correcting unit for correcting the fuel injection amount according to the throttle opening. The fuel injection control system further includes: a throttle body so configured that a throttle valve can be turned to an over-fully opened position at which the opening is greater than a fully opened position corresponding to saturation of the flow rate of air flowing into the engine and at which the air flow rate is maintained at a saturation rate; and a correction unit for correcting the fuel injection amount to the lean side of a fuel-air mixture when the throttle valve is turned from a fully closed position to a fully open position and for correcting the fuel injection amount to the rich side of the fuel-air mixture according to an increase in the throttle opening when the throttle valve is turned beyond the fully open position to the over-fully opened position.

In addition, the present invention is directed to a fuel injection control system that further includes an ignition timing setting unit having a correcting unit for correcting a reference ignition timing, determined based on the engine speed, according to the concentration of the fuel-air mixture corrected to the lean side or the rich side.

According to the first aspect of the present invention, low fuel consumption by lean combustion can be performed in a wide range from the fully closed position to the fully open position. In addition, in the range from the fully open position to the over-fully opened position, a high output can be obtained by enriching the fuel-air mixture according to the throttle opening. The control in the range from the lean combustion to a high-output operation conducted by use of the fuel-air mixture according to the output can be performed by only adjusting the throttle opening. Therefore, it is unnecessary to operate a mixture lever for enriching the fuel-air mixture. In view of this, the burden on the pilot of an aircraft or the like on which the engine control system according to the present invention is mounted can be alleviated.

According to the second aspect of the present invention, an optimum ignition timing can be obtained according to the concentration of the fuel-air mixture.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a main flow chart of an engine control;

FIG. 5 is a flow chart illustrating the procedure of a fuel-air ratio setting process;

DETAILED DESCRIPTION OF THE PREFERRED EMBODIMENTS

Figure 1:
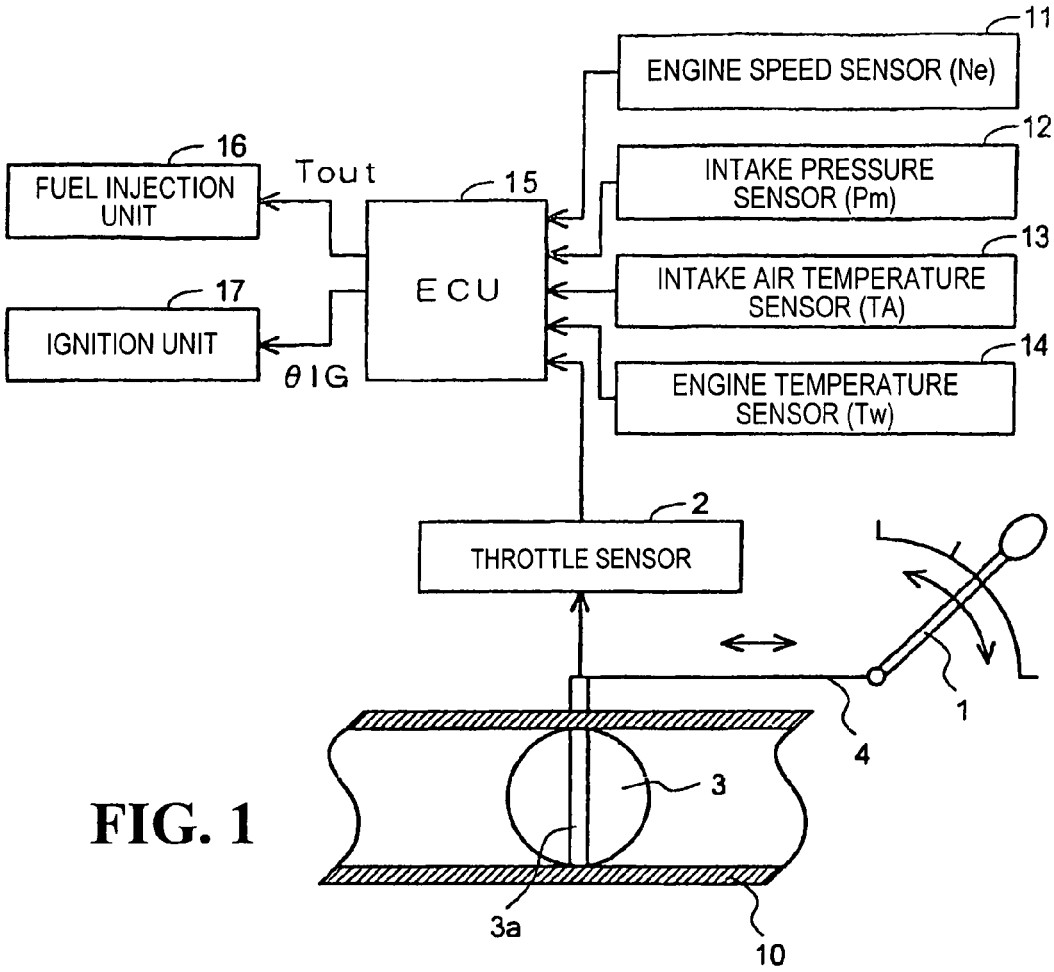
FIG. 1 is a block diagram of a major part of an engine control system according to an embodiment of the present invention.

The present invention will now be described with reference to the accompanying drawings, wherein the same or similar elements will be identified with the same reference numerals. FIG. 1 is a block diagram of a major part of an engine control system according to an embodiment of the present invention. It should be noted that only the configurations necessary for understanding the present invention are shown in FIG. 1 for ease of understanding.

A throttle body 10 is provided in an intake pipe of a reciprocating engine in an aircraft, for example. The throttle body 10 includes a throttle valve 3. The throttle valve 3 is linked to a power lever 1 through a link mechanism (including a push-pull wire) 4, and is turned in response to the operation of the power lever 1. The opening θ Th of the throttle valve 3 is detected by a throttle sensor 2 connected to a shaft (throttle shaft) 3*a* of the throttle valve 3.

An engine speed sensor 11 detects the engine speed Ne. An intake pressure sensor 12 detects the intake pipe internal pressure Pm. An intake air temperature sensor 13 detects the temperature TA of air inside the intake pipe. An engine temperature sensor 14 detects the engine temperature TW based on the temperature of cooling water that flows through the engine.

An ECU 15 obtains a valve opening time Tout of an injector (fuel injection valve) and engine ignition timing θ IG, based on process values detected by the above-mentioned sensors. The ECU 15 then inputs the obtained values to a fuel injection unit 16 and an ignition unit 17. According to the valve opening time Tout and the engine ignition timing θ IG thus inputted, the fuel injection unit 16 drives the injector and the ignition unit 17 applies a high voltage to a spark plug.

Figure 2:
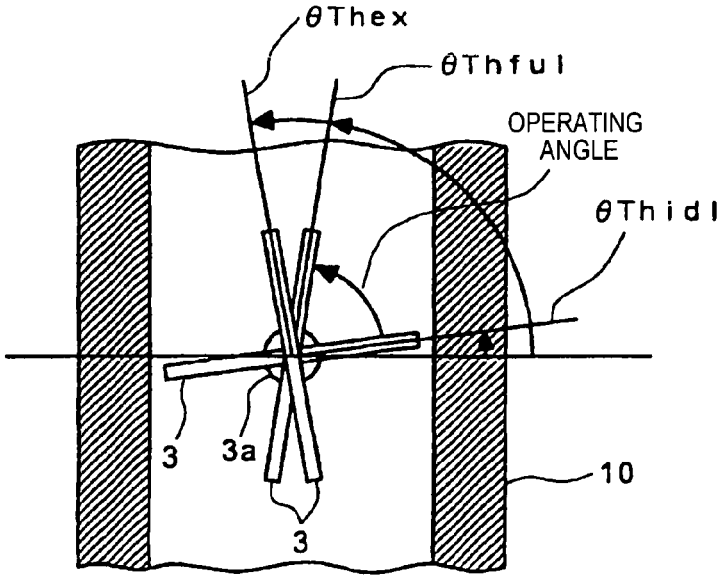
FIG. 2 is a sectional view of a throttle body, showing the relationship between the fully opened position and the over-fully opened position of a throttle valve.

FIG. 2 is an enlarged sectional view of the throttle body 10. The throttle valve 3 has an operating angle ranging from an idle opening θ Thidl, opened by a minute angle from a fully closes position, to a fully opened position θ Thful at which an air flow rate for a maximum output can be secured. The fully opened position is set at an angle of 90° or slightly smaller than 90°.

The throttle shaft 3*a* for turnably supporting the throttle valve 3 relative to the throttle body 10 impedes the air flow in the throttle body 10. Therefore, even when the throttle opening is enlarged further from the fully opened position θ Thful within the range of the diameter of the throttle shaft 3*a* in a direction that crosses the throttle body 10, the air flow rate is not increased. The air flow rate is not increased due to the air flow being blocked by the throttle valve 3*a*.

In short, a throttle opening θ Th which is in excess of the fully opened position θ Thful is possible. This throttle opening θ Th is referred to as an over-fully opened position θ Thex. At this over-fully throttle opening θ Thex, the air flow rate is the same as that at the fully opened position θ Thful. In other words, it is possible to have an over-fully throttle opening θ Thex that is greater than the fully opened position θ Thful and that has the same air flow rate as the fully opened position θ Thful until the air flow rate begins to decrease from that at the fully opened position θ Thful.

In this embodiment, an operation of the throttle valve 3 in the range from the fully opened position θ Thful to the over-fully opened position θ Thex (a region in which the air flow rate remains unchanged; namely, a dead region) is made possible. By utilizing this operation of the throttle valve 3, it is possible to fully achieve the full output performance of the engine.

Figure 3:
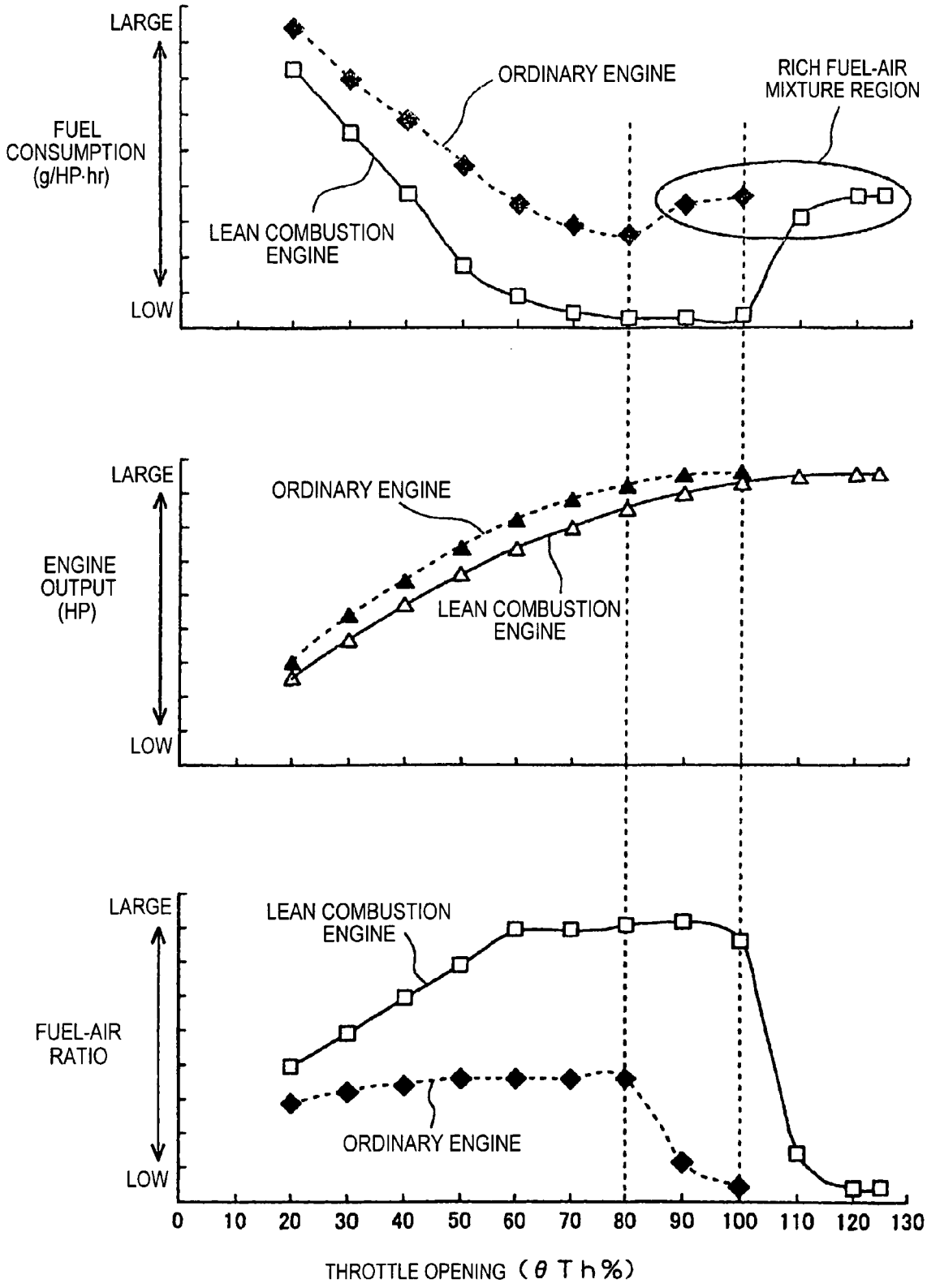
FIG. 3 shows diagrams illustrating the relationship of the throttle opening with air-fuel ratio, fuel consumption, and output.

FIG. 3 shows characteristic diagrams illustrating relationships between the throttle opening and the air-fuel ratio, the fuel consumption, and the output for an ordinary engine and a lean combustion type engine. As can be understood from FIG. 3, for both the ordinary engine and the lean combustion type engine, the air-fuel ratio is lowered when the throttle opening θ Th is enlarged to a certain extent. In other words, a lean combustion operation becomes impossible in the range where the throttle opening θ Th is large. In order to obtain an output according to the throttle opening θ Th, the fuel injection amount is increased so as to enrich the fuel-air mixture. In the ordinary engine, the fuel-air mixture is enriched when the throttle valve θ Th exceeds 80%. On the other hand, in the lean combustion type engine, a lean combustion operation at a high air-fuel ratio is possible in a range of up to a throttle opening θ Th of 100%; namely, up to the fully opened position θ Thful.

In this embodiment of the present invention, the operation of the throttle valve 3 is made possible up to the over-fully opened position θ Thex (in the example shown in FIG. 3, 125%), so that it is possible to enrich the fuel-air mixture, thereby increasing the output, according to the variation in the throttle valve θ Th from the fully opened position θ Thful to the over-fully opened position θ Thex.

The engine control by the ECU 15 based on the throttle opening θ Th as described above will be described in detail. FIG. 4 illustrates a main flow of the engine control, which is periodically executed in the ECU 15.

In step S1, an air-fuel ratio setting process for calculating the valve opening time Tout of the injector is executed. The air-fuel ratio setting process will be further described later, referring to FIG. 5. In step S2, an ignition timing setting process for calculating an ignition timing, i.e., a total spark advance θ IG is executed. The ignition timing setting process will be further described later, referring to FIG. 7.

In step S3, the fuel injection unit 16 is controlled based on the valve opening time Tout of the injector. The ignition unit 17 is controlled based on the total spark advance θ IG.

The air-fuel ratio setting process will be further described. In FIG. 5, a basic fuel-air ratio FA is set in step S101. In this embodiment, a value equivalent to an air-fuel ratio (A/F) of 12.5 is set. In step S102, the intake pressure Pm detected by the intake pressure sensor 12 and the intake air temperature TA detected by the intake air temperature sensor 13 are read. In step S103, a battery voltage compensation constant Tv for increase/decrease compensation of the valve opening time of the injector according to the variation in battery voltage is obtained.

In step S104, the cooling water temperature TW detected by the engine temperature sensor 14 is compared with a first reference temperature TWH1. The first reference temperature TWH1 is a reference value for judging whether the engine is in a cooled state or not. When the cooling water temperature TW is in excess of the first reference temperature TWH1, then proceed to step S105. In step S105, the cooling water temperature TW detected is compared with a second reference temperature TWH2. The second reference temperature TWH2 is a reference value for judging whether the engine has been sufficiently warmed or not. When the cooling water temperature TW is in excess of the second reference temperature TWH2, then proceed to step S106. In other conditions, proceed to step S107. In step S106, "1" is set into a temperature compensation coefficient R. In step S107, a value Rx (0<Rx<1) is set into the temperature compensation coefficient R.

In step S108, the output voltage value Vth of the throttle sensor 2 is read, and the throttle opening θ Th (%) is calculated based on the voltage value Vth. In step S109, a leaning coefficient θ KH is calculated. The leaning coefficient θ KH is preset in a table form in correspondence with the throttle opening θ Th. The leaning coefficient θ KH is searched by referring to the table based on the throttle opening θ Th calculated in step S108. An example of the θ Th-KH table will be described later.

In step S110, the leaning coefficient KH is subjected to temperature compensation by the temperature compensation coefficient R, using the formula in the figure. When the cooling water temperature TW is less than the first reference temperature TWH1, the control process goes from step S104 to step S112 to set the leaning coefficient KH at "1", irrespectively of the throttle opening θ Th. Namely, the fuel-air mixture is not made lean when the engine temperature is low.

In step S111, the valve opening time Tout of the injector is calculated using the following formula 1.

$$Tout=K\times Pm/TA\times FA\times KH+Tv \quad \text{(Formula 1)}$$

In the formula 1, the coefficient K is a constant determined by the injection performance of the injector and the like.

Figure 6:
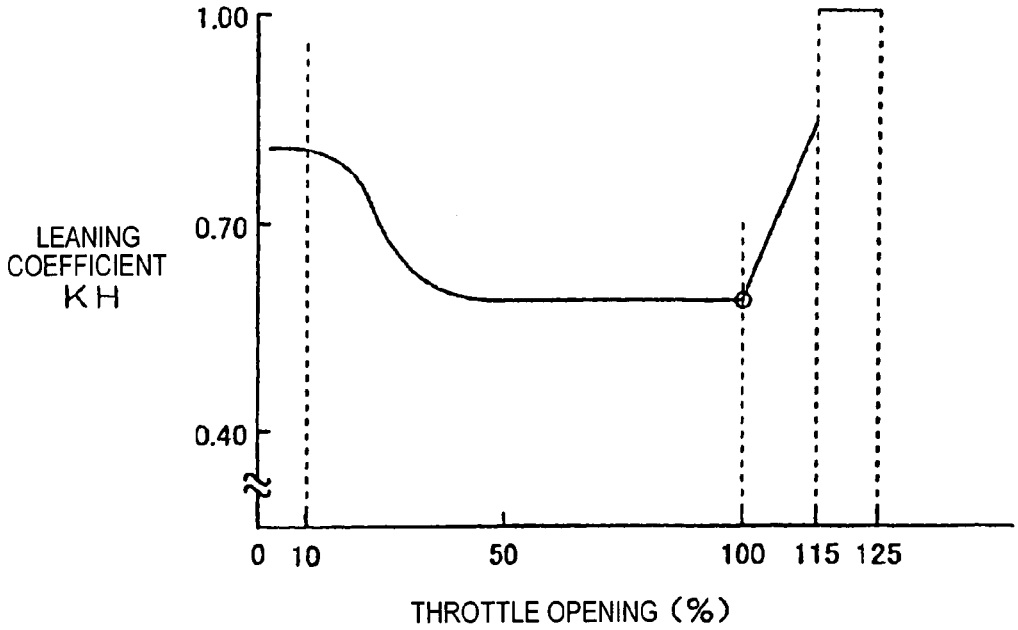
FIG. 6 is a diagram illustrating the relationship between the throttle opening θ Th and the leaning coefficient KH.

FIG. 6 shows an example of the table in which the relationship between the throttle opening θ Th and the leaning coefficient KH is set. As shown in the figure, in the range where the throttle opening θ Th is small (less than 10%), the leaning coefficient KH is so set that the air-fuel ratio corresponds to an idle fuel-air mixture. As the throttle opening θ Th increases, the leaning coefficient θ KH is reduced. Namely, the fuel-air mixture is made lean. Until the throttle opening θ Th increases to 100%, namely, the fully opened position θ Thful, the leaning coefficient θ KH is kept low and leaning is continued. When the throttle opening θ Th reaches 100%, the leaning coefficient θ KH is increased, and, when the throttle opening θ Th reaches 110%, the leaning coefficient θ KH is set to "1". Namely, the fuel-air mixture is not made lean. As a result, when the throttle opening θ Th increases beyond 110% to the over-fully opened position θ Thex of 125%, enrichment of the fuel-air mixture is obtained and the output is increased.

Figure 7:
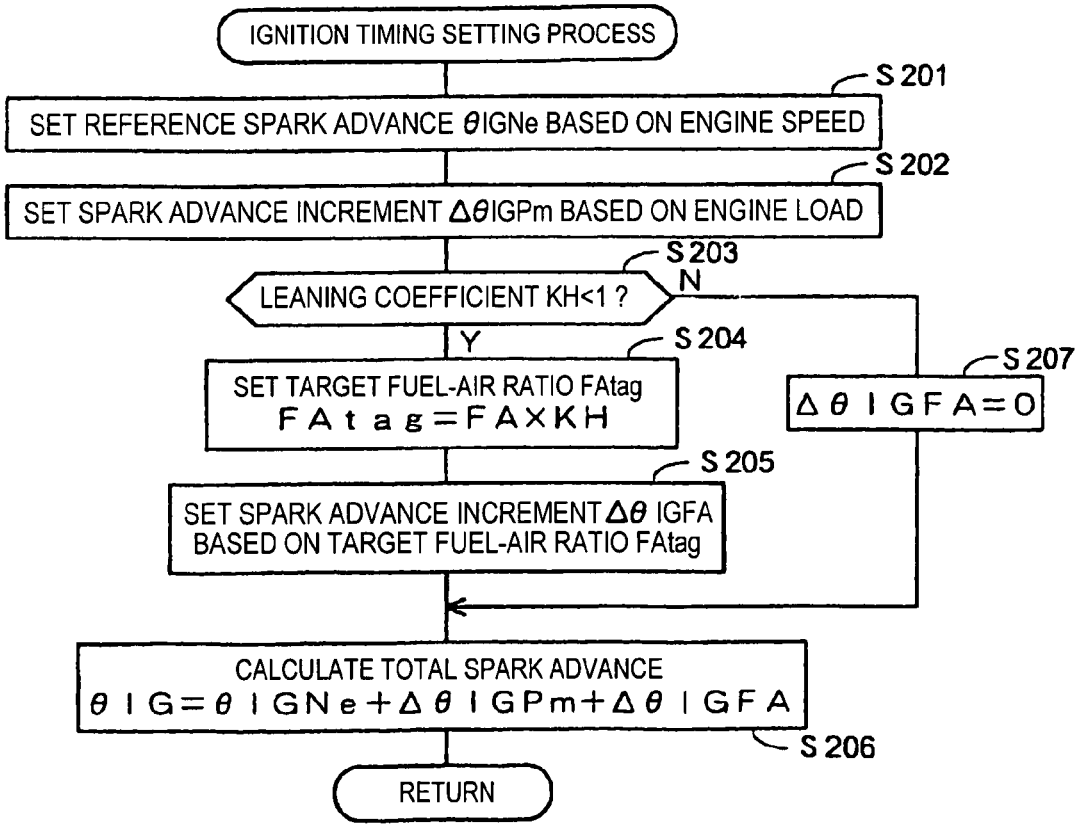
FIG. 7 is a flow chart illustrating the procedure of an ignition timing setting process.
Figure 8:
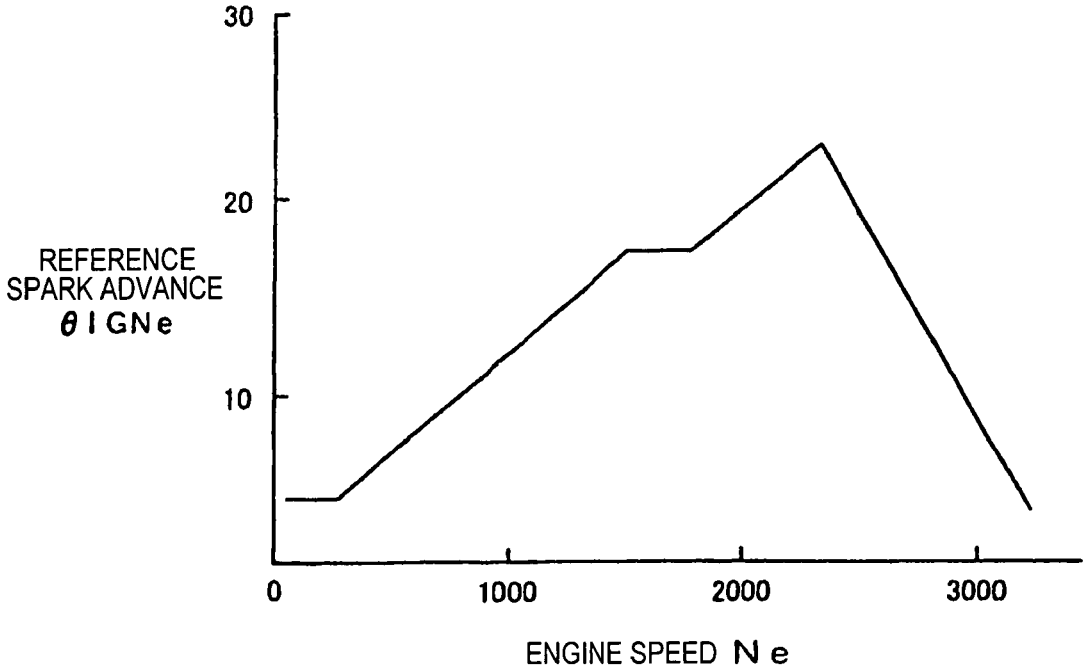
FIG. 8 is a diagram illustrating the relationship between the engine speed Ne and the reference spark advance θIGNe.

The ignition timing setting process will be further described. In FIG. 7, in step S201, a reference spark advance θ IGNe is obtained based on the engine speed Ne. In this embodiment, as shown in FIG. 8, a data table determining the relationship between the engine speed (Ne) and the reference spark advance (θ IGNe) is prepared in advance. The reference spark advance θ IGNe is obtained by searching the data table based on the engine speed Ne.

Figure 9:
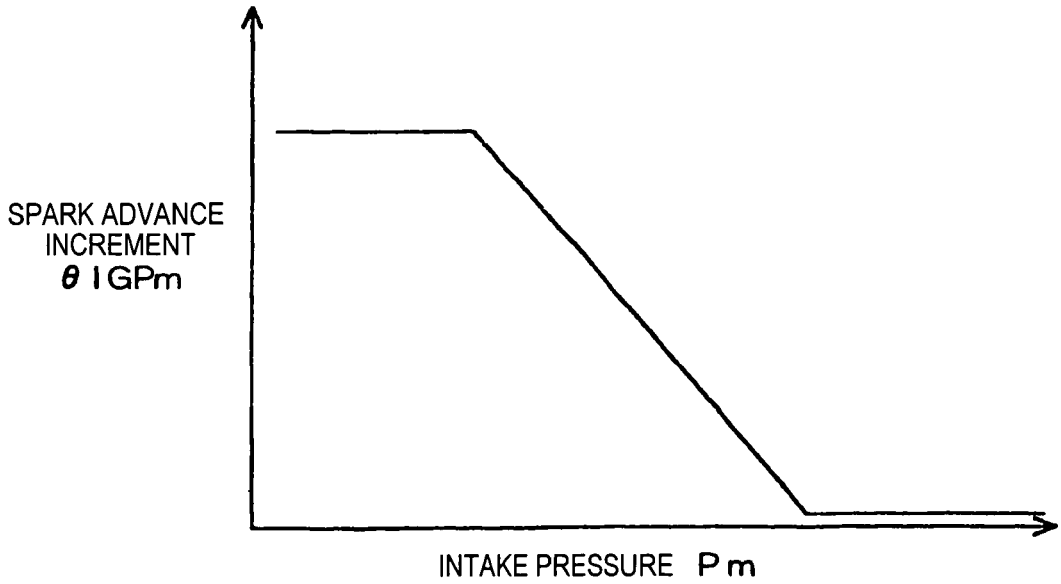
FIG. 9 is a diagram showing the relationship between the intake pressure Pm and the spark advance increment Δ θ IGFA.

In step S202, a spark advance increment Δ θ IGPm according to the engine load is obtained. In this embodiment, the engine load is represented by the intake pressure Pm. A data table determining the relationship between intake pressure Pm and spark advance increment Δ θ IGPm is prepared in advance as shown in FIG. 9. The spark advance increment Δ θ IGPm is obtained by searching the data table based on the intake pressure Pm.

In step S203, it is judged whether the leaning coefficient KH is smaller than "1" or not, and, when the leaning coefficient KH is less than "1", proceed to step S204. In step S204, a target fuel-air ratio FAtag is obtained as the product of the basic fuel-air ratio FA and the leaning coefficient KH, based on the following formula 2.

$$FAtag=FA\times Kh \quad \text{(Formula 2)}$$

Figure 10:
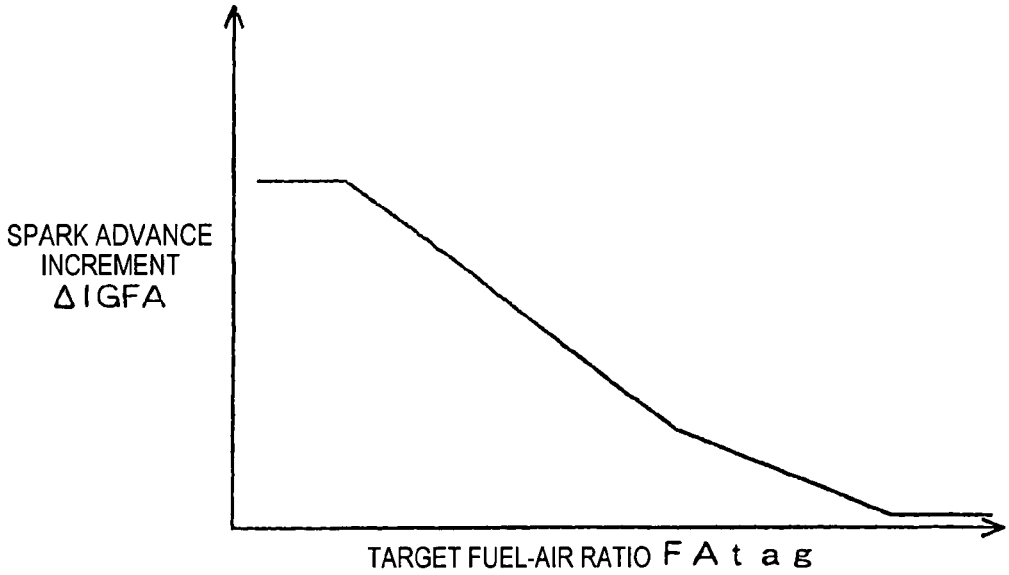
FIG. 10 is a diagram showing the relationship between the target fuel-air ratio FAtag and the spark advance increment Δ θ IGPm.

In step S205, the spark advance increment Δ θ IGFA is obtained based on the target fuel-air ratio FAtag. In this embodiment, a data table determining the relationship between target fuel-air ratio FAtag and spark advance increment Δ θ IGFA is prepared in advance as shown in FIG. 10. The spark advance increment Δ θ IGFA is obtained by searching the data table based on the target fuel-air ratio FAtag.

Incidentally, when it is found in step S203 that the leaning coefficient KH is not smaller than "1", the spark advance increment Δ θ IGFA is set to "0" in step S207. In step S206, the total spark advance θ IG is obtained as a sum total of the reference spark advance Δ θ IGNe, the spark advance increment Δ θ IGPm according to the engine load, and the spark advance increment Δ θ IGFA according to the target fuel-air ratio FAtag.

In this embodiment, the fuel-air mixture can be enriched according to the throttle opening θ Th detected by the throttle sensor 2 in the range of the throttle opening θ Th up to the over-fully opened position θ Thex (which is greater than the fully opened position θ Thful), so that it is possible to control the engine output in a wide rage. This meets the demand for a high-load operation by only operating the power lever 1 without the need to operate a mixture control lever. Therefore, it is possible to alleviate the burden on a pilot, for example. In addition, the ignition timing is dynamically controlled according to the engine load and the degree of leaning of the fuel-air mixture. Therefore, a further reduction in fuel cost can be attained.

A second embodiment of the present invention will now be described. The inside diameter of the throttle body (throttle bore diameter) is set to a minimum size making it possible to secure an air flow rate required at the time of a maximum engine output. When a throttle body with the optimum bore diameter thus set is used, an increase in air flow rate can be obtained according to an increase in throttle opening. Furthermore, a maximum output can be secured at the fully opened position θ Thful of the throttle valve.

When a bore diameter larger than the optimum bore diameter is selected, it is possible to secure an air flow rate that is required at an opening smaller than the fully opened position θ Thful. There arises an opening region where the air flow rate is saturated at a greater throttle opening.

Figure 11:
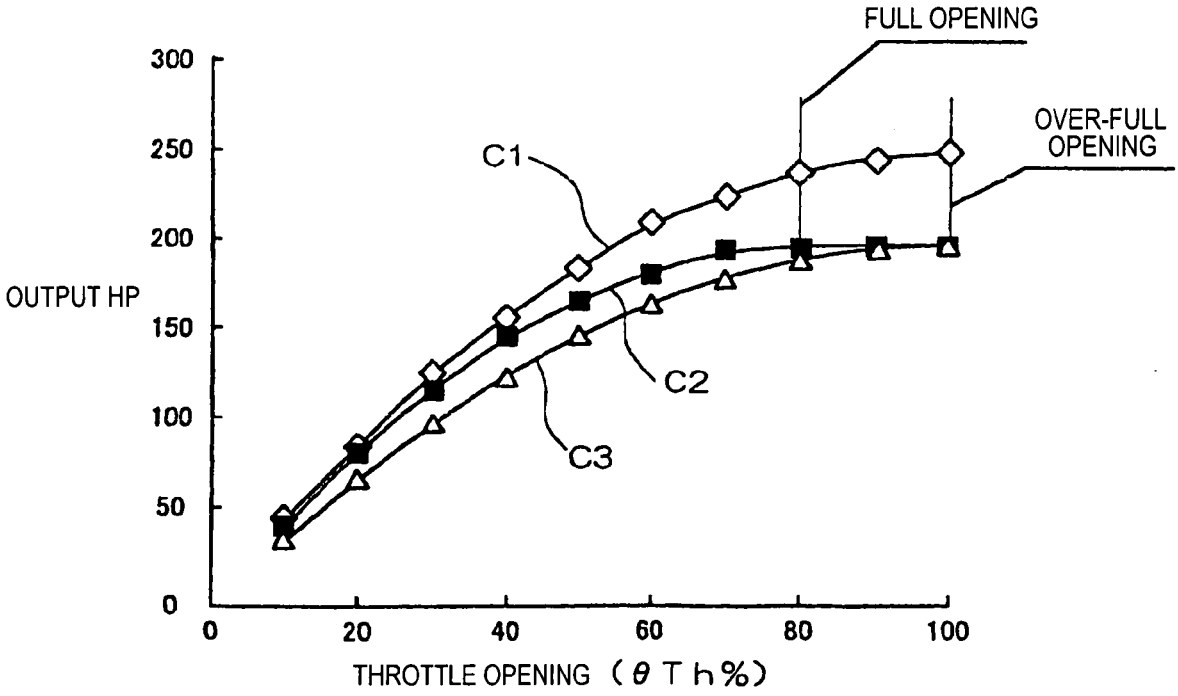
FIG. 11 is a diagram showing the relationship between the output and the throttle opening, for illustrating the effect of the throttle bore diameter.
Figure 12:
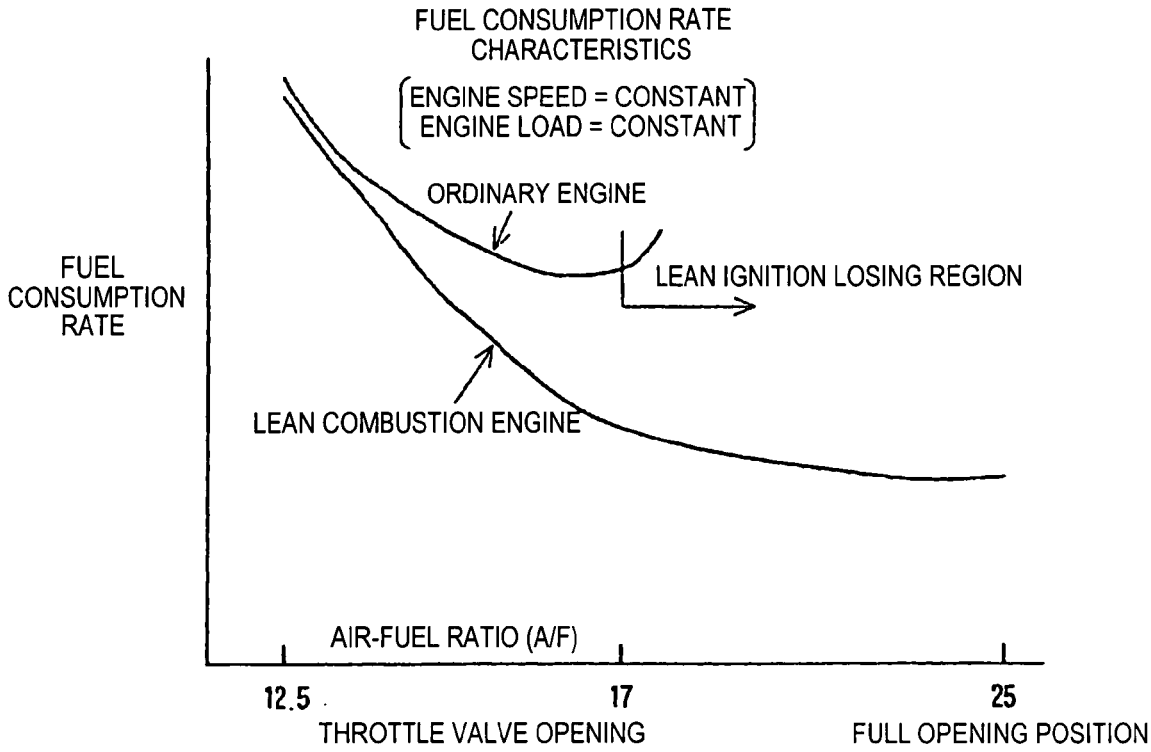
FIG. 12 is a diagram showing the relationship between the air-fuel ratio (and the throttle opening) and the fuel consumption rate, for a lean combustion type engine and an ordinary engine.

FIG. 11 is a diagram illustrating the relationship between the output and the throttle opening, for various combinations of engine exhaust amount and throttle bore diameter. Curve C1 indicates the characteristic in a combination of an engine E1 having a large exhaust amount and a throttle bore diameter (big bore diameter) suitable for the engine E1. Curve C2 indicates the characteristic in a combination of an engine E2 having an ordinary exhaust amount (e.g., smaller than the large exhaust amount by 25%) and a big bore diameter. Curve C3 indicates the characteristic in a combination of an engine E2 having an ordinary exhaust amount and a throttle bore diameter suitable for the engine E2. The output and the air flow rate are substantially proportional to each other. Therefore, when a throttle body with a larger diameter is mounted to the engine E2 with the ordinary exhaust amount, the output, i.e. the air flow rate, is saturated at a throttle opening θ Th of not less than 80%, as indicated by curve C2.

According to the characteristic shown in FIG. 11, when a throttle body with a big bore diameter is mounted to the engine E2, the fully opened position θ Thful indicated in relation to FIG. 2 can be used as the over-fully opened position θ Thex in the second embodiment. In addition, an angle smaller than the fully opened position θ Thful in FIG. 2 can be used as the fully opened position θ Thful in the second embodiment.

When the fully opened position θ Thful and the over-fully opened position θ Thex are thus set on the small throttle opening side, the same effects as in the above-described embodiment in which the throttle valve 3 is turnable in a wide angle range can be obtained by the same control as in the above embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection control system for an engine, the engine comprising a manifold pressure sensor, a calculating unit for calculating a fuel injection amount according to an output from the manifold pressure sensor, a throttle opening sensor, and a correction unit for correcting the fuel injection amount according to a throttle opening θ Th, said fuel injection control system comprising:

a throttle body having a throttle valve in which a fully opened position θ Thful of the throttle opening θ Th is an angle substantially equal to 90°, said throttle body being configured so that a throttle valve is capable of being turned to a over-fully opened position θ Thex that has an angle greater than the angle of the fully opened position θ Thful that corresponds to a saturation air flow rate of air flowing into the engine, and where the saturation air flow rate is maintained when the throttle valve is in the over-fully opened position θ Thex; and a correction unit for correcting the fuel injection amount to a lean side of a fuel-air mixture when said throttle valve is turned from a fully closed position to the fully opened position θ Thful and for correcting the fuel injection amount to a rich side of the fuel-air mixture according to an increase in the throttle opening θ Th when the throttle valve is turned to an angle beyond the fully opened position θ Thful to said over-fully opened position θ Thex.

2. The fuel injection amount control system for an engine according to claim 1, further comprising an ignition timing setting unit having a correction unit for correcting a reference ignition timing, determined based on the engine speed, according to the concentration of said fuel-air mixture corrected to said lean side or said rich side.

3. The fuel injection amount control system for an engine according to claim 1, wherein the throttle valve is movable from the fully closed position to the fully opened position θ Thful and from the fully opened position θ Thful to the over-fully opened position θ Thex by operating only a power lever.

4. The fuel injection amount control system for an engine according to claim 1, further comprising an air-fuel ratio setting unit for calculating a valve opening time of the fuel injector.

5. The fuel injection amount control system for an engine according to claim 1, wherein the over-fully opened position θ Thex of the throttle valve is 125% of the fully opened position θ Thful of the throttle valve.

6. The fuel injection amount control system for an engine according to claim 1, wherein the fully opened position θ Thful of the throttle opening θTh is an angle not greater than to 90°.

7. A fuel injection control method for an engine, the engine comprising a manifold pressure sensor, a calculating unit for calculating a fuel injection amount according to an output from the manifold pressure sensor, a throttle opening sensor, and a correction unit for correcting the fuel injection amount according to a throttle opening θ Th, said fuel injection control method comprising the steps of:

configuring a throttle body having a throttle valve in which a fully opened position θ Thful of the throttle opening θ Th is an angle substantially equal to 90°, and so that a throttle valve is capable of being turned to a over-fully opened position θ Thex that is an angle greater than the angle of the fully opened position θ Thful that corresponds to a saturation air flow rate of air flowing into the engine, and where the saturation air flow rate is maintained when the throttle valve is in the over-fully opened position θ Thex; and correcting the fuel injection amount to a lean side of a fuel-air mixture when said throttle valve is turned from a fully closed position to the fully opened position θThful and correcting the fuel injection amount to a rich side of the fuel-air mixture according to an increase in the throttle opening θ Th when the throttle valve is turned beyond the fully opened position θ Thful to said over-fully opened position θ Thex.

8. The fuel injection amount control method for an engine according to claim 7, further comprising the step of correcting a reference ignition timing, determined based on the engine speed, according to the concentration of said fuel-air mixture corrected to said lean side or said rich side.

9. The fuel injection amount control method for an engine according to claim 7, further comprising the step of moving the throttle valve from the fully closed position to the fully opened position θ Thful and from the fully opened position θ Thful to the over-fully opened position θ Thex by operating only a power lever.

10. The fuel injection amount control method for an engine according to claim 7, further comprising the step of calculating a valve opening time of the fuel injector.

11. The fuel injection amount control method for an engine according to claim 7, further comprising the step of opening the throttle valve to the over-fully opened position θ Thex that is 125% of the fully opened position θ Thful of the throttle valve.

12. The fuel injection amount control method for an engine according to claim 7, wherein the fully opened position θ Thful of the throttle opening θTh is an angle not greater the 90°.

13. A fuel injection control system for an engine, the engine comprising a calculating unit for calculating a fuel injection amount, said fuel injection control system comprising:

a throttle body, said throttle body being configured so that a throttle valve is capable of being moved from a throttle opening θ Th in a fully closed position to a fully opened position θ Thful defined by an angle substantially equal to 90°, a correction unit for correcting the fuel injection amount to a lean side of a fuel-air mixture when said throttle valve is turned from the fully closed position to the fully opened position θ Thful and for correcting the fuel injection amount to a rich side of the fuel-air mixture according to an increase in the throttle opening θ Th when the throttle valve is turned to a over-fully opened position θ Thex having an angle that is greater than the angle of the fully opened position θ Thful, wherein the fully opened position θ Thful corresponds to a saturation air flow rate of air flowing into the engine, and the air flowing into the engine is maintained at the saturation air flow rate when the throttle valve is in the over-fully opened position θThex.

14. The fuel injection amount control system for an engine according to claim 13, further comprising an ignition timing setting unit having a correction unit for correcting a reference ignition timing, determined based on the engine speed, according to the concentration of said fuel-air mixture corrected to said lean side or said rich side.

15. The fuel injection amount control system for an engine according to claim 13, wherein the throttle valve is movable from the fully closed position to the fully opened position θ Thful and from the fully opened position θ Thful to the over-fully opened position θ Thex by operating only a power lever.

16. The fuel injection amount control system for an engine according to claim 13, further comprising an air-fuel ratio setting unit for calculating a valve opening time of the fuel injector.

17. The fuel injection amount control system for an engine according to claim 13, wherein the over-fully opened position θ Thex of the throttle valve is 125% of the fully opened position θ Thful of the throttle valve.

18. The fuel injection amount control system for an engine according to claim 13, wherein the fully opened position θ Thful of the throttle opening θ Th is an angle not greater the 90°.

* * * * *